United States Patent [19]

Hennessy

[11] 4,400,914

[45] Aug. 30, 1983

[54] SLIDING DOOR OPERATING MEANS

[75] Inventor: James J. Hennessy, Chambersburg, Pa.

[73] Assignee: Hennessy Products, Incorporated, Chambersburg, Pa.

[21] Appl. No.: 287,762

[22] Filed: Jul. 29, 1981

[51] Int. Cl.[3] ..... E05F 11/54

[52] U.S. Cl. ..... 49/362; 464/88

[58] Field of Search ..... 49/362, 358, 360; 464/88

[56] References Cited

U.S. PATENT DOCUMENTS

| | | | |
|---|---|---|---|
| 1,646,427 | 10/1927 | Skidmore, Jr. | 464/88 X |
| 2,857,777 | 10/1958 | Porter | 464/88 X |
| 2,867,102 | 1/1959 | Williams | 464/88 |
| 2,867,103 | 1/1959 | Williams | 464/88 |
| 3,883,992 | 5/1975 | Bollinger, Sr. | 49/362 |

*Primary Examiner*—Philip C. Kannan

*Attorney, Agent, or Firm*—F. Travers Burgess

[57] ABSTRACT

Sliding door operating means comprises a wall-mounted rack, operating mechanism connected to said door and having a pinion meshing with the rack and means for manually rotating said pinion to move the door between open and closed positions, and an energy-absorbing coupling between the manually actuated means and the pinion for absorbing rotational energy resulting from the inertia of the manually actuated means when the door reaches the end of its travel either to the open or completely closed position.

5 Claims, 4 Drawing Figures

SLIDING DOOR OPERATING MEANS

BACKGROUND OF THE INVENTION

Field of the Invention

The invention relates to closures and consists particularly in means for moving sliding doors between open and closed positions.

The Prior Art

Luther L. Bollinger, Sr. U.S. Pat. No. 3,883,992 discloses railway car side door operating structure comprising a rack extending lengthwise of and secured to a railway car side wall adjacent the door opening and an operating mechanism comprising a pair of pinions engaging the rack and manually actuated means directly mechanically connected to a pinion for rotating the pinion and thereby causing movement of the mechanism along the rack and of the door along the wall between open and closed positions. While effective to move the door, the mechanism of this patent was subject to damage because, when the door is moved rapidly along the wall and door movement ceases abruptly by contact with either the door stop during opening movements or the door jamb when closing, the kinetic energy developed in the handwheel by the rapid rotation of the pinion causes the handwheel to keep rotating like a flywheel and the torque transmitted therefrom to the pinion is frequently sufficient to strip the driving gears in the gear box or the teeth on the rack.

SUMMARY OF THE INVENTION

The purpose of the invention is to provide a door opening mechanism comprising a wall-mounted rack and manually operable pinion meshing with the rack and connecting to the door in which rotational inertial forces in the manually operable means are absorbed between the manually operable means and the pinion driving means upon abrupt stoppages of the door during closing and opening movements thereof so as to prevent damage to the driving gears, pinion or rack teeth as a result of these inertial forces.

A further object is the provision of an energy absorbing coupling between the manually actuated means and the pinion driving means capable of absorbing rotational inertial forces in the manually actuable means in the event of abrupt cessation of movements of the door in either open or closed directions.

A further object of the invention is to utilize a coupling between the manually actuated means and the pinion driving means comprising a pair of internally toothed input and output members and an externally and internally toothed annular member of elastomeric material meshing with said input and output members and adapted to absorb the inertia of the manually actuated member when the door is stopped suddenly by hitting the door stop or the door jamb when the manually actuated member is spinning rapidly.

DETAILED DESCRIPTION OF THE INVENTION

Figure 1:
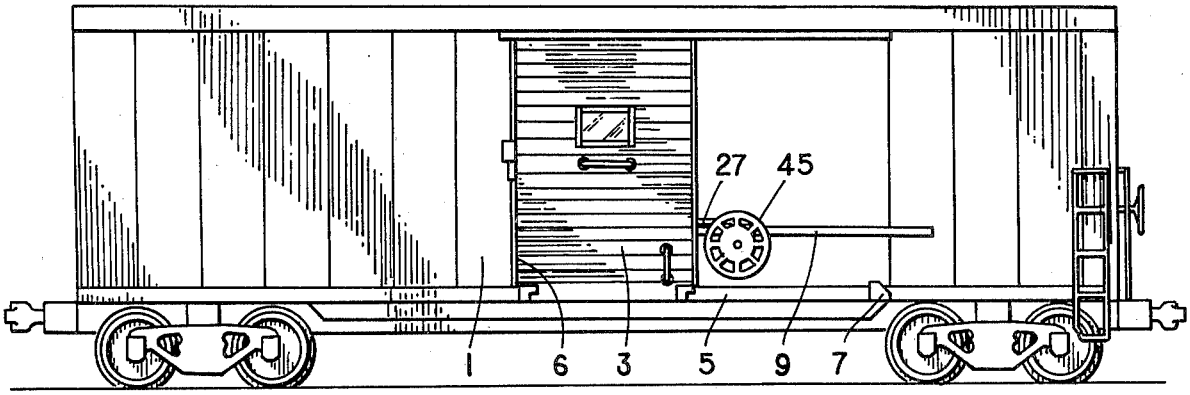
FIG. 1 is a side elevational view of a railway house car equipped with a door operating means constructed in accordance with the invention.
Figure 2:
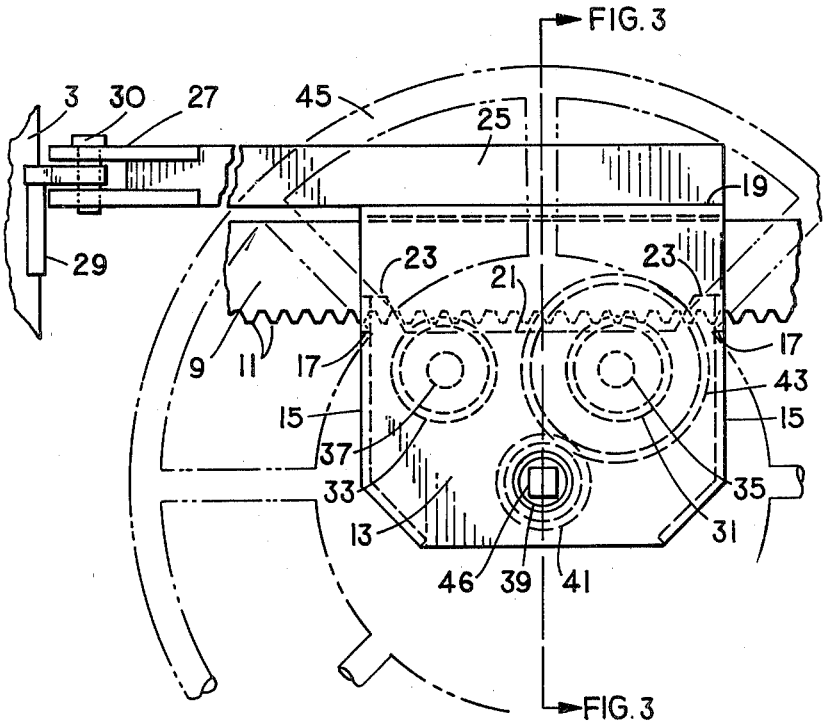
FIG. 2 is an enlarged side elevational view of the operating mechanism with the handwheel removed showing an adjacent portion of the rack.
Figure 3:
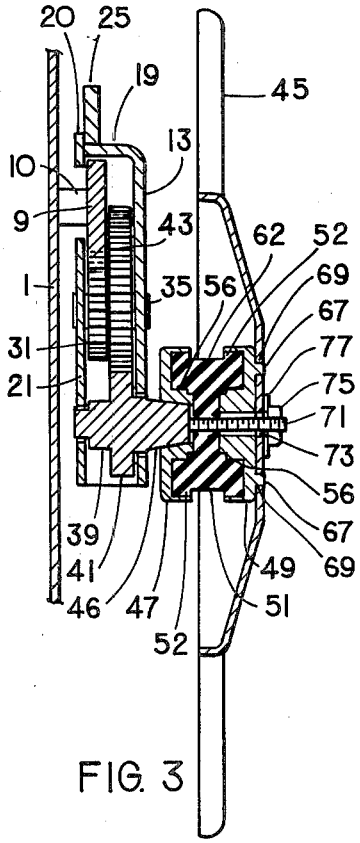
FIG. 3 is a transverse vertical sectional view of the operating mechanism taken along line 3—3 of FIG. 2.
Figure 4:
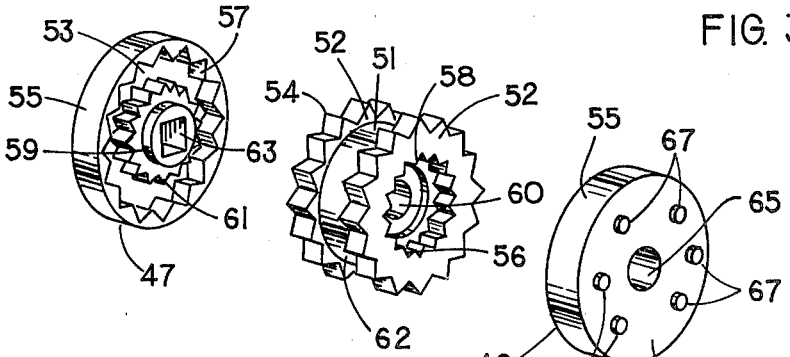
FIG. 4 is an exploded isometric view of the energy absorbing coupling.

The numeral 1 denotes the side wall of a railway house car having a central door opening therein closed by a door 3 supported on a track 5 extending longitudinally of the wall below the door opening, door 3 being slidable along track 5 between a fully closed position in which its front edge engages the front door post 6 and a fully open position in which its rear edge engages door stop member 7 on track 5. For moving the door between open and closed positions, a downwardly toothed rack 9 is affixed by brackets 10 to the car side wall 1 in slightly outwardly spaced relation thereto and has a substantially smooth upper surface and teeth 11 on its lower edge. A gear box, as best seen in FIGS. 2 and 3, has a front cover assembly 13 and transverse sides 15 cut out as at 17 to permit passage therethrough of rack 9, with an inwardly extending top wall portion 19 resting on the smooth top edge of rack 9. Top wall portion 19 mounts along its inner edge a flat bar 20, the lower margin of which depends behind rack 9, and rear cover plate 21 has a pair of upwardly facing ears 23 adapted to oppose the inner surface of the rack 9 when the gear box is assembled and thereby hold the gear box on the rack. The gear box is also formed with a longitudinal extension 25 toward door 3, the front end of extension 25 being formed with a clevis 27 adapted to receive a bracket 29 mounted on the rear edge of door 3, to which it is connected by pin 30. Immediately beneath rack 9 an operating pinion 31 and an idler pinion 33 are journaled on transverse axes 35 and 37 in the gear box wall structure. A drive shaft 39 is also journaled in the gear box wall structure at a lower level and substantially intermediate shafts 35 and 37 longitudinally of the gear box and mounts within the gear box a drive gear 41, drivingly engage an intermediate gear 43 affixed to shaft 35 so as to produce rotation of operating pinion 31 at a substantial mechanical advantage when drive shaft 39 and drive gear 41 are rotated.

For rotating drive gear 41, a handwheel 45 is connected to the outwardly projecting square end 46 of drive shaft 37 by a flexible coupling of the general type disclosed in W. A. Williams U.S. Pat. No. 2,867,103, comprising outer and inner connecting elements 47 and 49 connected to each other by an elastomeric sleeve 51, which may be made of the synthetic elastomer ethylene propylene diene monomer (EPDM). This synthetic polymer is well suited to service in the coupling. It has excellent resistance to weather aging and ozone, a much wider range of temperature limitations than the coupling would be subjected to under service conditions. A torque reading of 450 in. lbs. has a power transmission element well in excess of that required and a high flex fatigue limit.

Connecting elements 47 and 49 are generally dish-shaped with a flat web 53 and a generally cylindrical rim 55 inwardly circumferentially serrated as at 57. Inner connecting element 47 has a central hub portion 59 outwardly serrated as at 61, and formed with a square aperture 63 at its center to receive the protruding square end 46 of drive shaft 39. The internal construction of connecting element 49 is identical to that of connecting element 47 except that connecting element 49 has a circular central aperture 65 instead of the square aperture 63 of connecting element 47 and handwheel 45 is held against rotation with respect to connecting element 49 by a plurality of circumferentially spaced bosses 67 projecting outwardly from the web 53 of connecting element 49 and received in cooperating holes 69 in handwheel 45. For securing handwheel 45 and coupling 47, 49, 51 to drive shaft 39, drive shaft 39 has an axially projecting threaded stud 71 which passes through sleeve 51, connecting member 49 central aperture 65 and a central circular aperture 73 in handwheel 45 and a nut 76 is threadably secured to the projecting end of stub 71 and is separated from the outer surface of the handwheel by a washer 77 to facilitate slight relative rotation of handwheel 45 with respect to the drive shaft 39 as may be accommodated by torsional shear in sleeve 51. Sleeve 51 has radially projecting end portions 52 serrated as at 54 conjugally with respect to inwardly directed serrations 57 of connecting elements 47 and 49 and shallow cylindrical recesses 56 at each end of sleeve 51 have inwardly directed serrations 58 conjugal with respect to the serrations 61 on the hub portions 59 of connecting elements 47 and 49. Cylindrical recesses 56 in the end of the sleeve are connected by a smaller diameter central opening 60. Between the serrated end portions 52 of the sleeve, the central portion has a cylindrical outer surface 62 of slightly less diameter than serrated end portions 52, and connecting elements 47 and 49 anti-rotatably receive the serrated end portions of the sleeve in the cavities defined between their respective rims 55 and hubs 59 with the sleeve outer serrations 54 meshing with the rim serrations 57 of connecting elements 47 and 49 and the internal serrations 58 of the sleeve meshing with the hub serrations 61 of connecting elements 47 and 49, such that when the door reaches its stops in either the opening or closing direction the rotational inertia of handwheel 45 will be absorbed through the torsional shear yieldability of sleeve 51 intermediate portion 62 and will not be transmitted to drive gear 41 and therefrom through intermediate gear 43 to operating pinion 31 and will thus eliminate damage to the rack teeth 11 or the teeth of pinion 35 or of the mechanism gear train.

Operation of the device is as follows: To open the door the operator rotates handwheel 45 clockwise causing pinion 31 to rotate counterclockwise and move the gear box 13, 15, 19, 21 to the right along rack 9 pulling door 3 along with it until the rear edge of the door 3 strikes door stop 7 preventing further movement of the door. At the instant this occurs the linear motion of the gear box along rack 9 terminates and opposes any further rotation of the gear train including pinion 31, intermediate gear 43, driving gear 41 and drive shaft 39, but the inertia of handwheel 45 causes it to continue rotating. As handwheel 45 continues to rotate, instead of its rotational moment being imparted to drive shaft 39 and the succeeding gear train with resultant damage to the gear teeth and/or the rack teeth, the rotational movement of the handwheel simply winds up sleeve 51 and is absorbed thereby when the engagement of the door and door stop prevent further rotation of the gear train parts after which the resilience of sleeve 51 causes the sleeve to return to its original condition. The torsional wind-up of sleeve 51 reduces the rotational moment transmitted through it from the handwheel and subsequently transfers energy well below the breakage strengths of the gears or the rack teeth preventing damage to the same. The same effect is provided when the device is utilized to move the door from open to closed position and the door movement in closing direction is stopped by engagement of the front edge of the door with the front door post.

The details of the construction may be varied substantially without departing from the spirit of the invention and the exclusive use of such modifications as come within the scope of the appended claims is contemplated.

I claim:

1. The combination of a side wall having a door opening, a door movable along said wall between positions closing and exposing said opening, an elongated rack extending lengthwise of said wall and secured thereto, operating mechanism connected to said door and having a pinion meshing with the rack, manually actuated means for rotating said pinion to move the door between open and closed positions, and an energy absorbing coupling between said manually actuated means and said pinion for absorbing rotational energy resulting from the inertia of the manually actuated means when the door reaches the end of its travel either to the opened or completely closed positions, said operating mechanism having a drive shaft drivingly connected to said pinion and having a common rotational axis with said manually actuated means, said energy absorbing coupling comprising an elastomeric sleeve antirotatably connected at one end to said manually actuated means and at the other end to said drive shaft, said drive shaft having an axially projecting portion extending through said coupling and through a central hole in said manually actuated means and a fastening device detachably secured to said projecting portion externally of said manually actuated means in abutting relation to the outer surface of said manually actuated means to hold said manually actuated means, said coupling and said drive shaft in assembled relation with each other while accommodating such rotation of said manually actuated means relative to said drive shaft as is permitted by yieldability of said elastomeric sleeve in torsional shear.

2. The combination according to claim 1, wherein, in addition to said elastomeric sleeve, said energy absorbing coupling comprises separate connecting elements spaced apart axially from each other and anti-rotatively secured respectively to said drive shaft and to said manually actuated means and both having circumferential surfaces of varying radii from said common axis, said elastomeric sleeve having conjugal circumferential surfaces meshing with said connecting element surfaces whereby energy is absorbed through torsional shear in said elastomeric sleeve.

3. The combination according to claim 2, wherein said circumferential surfaces are serrated.

4. The combination according to claim 3, wherein said connecting elements have inwardly directed serrations and said sleeve has outwardly directed conjugal serrations.

5. The combination according to claim 4, wherein said connecting elements have outwardly serrated hubs and said elastomeric sleeve has central aperture means inwardly serrated for meshing with said hub serrations.

* * * * *